United States Patent [19]

Alexander

[11] Patent Number: 4,819,335

[45] Date of Patent: Apr. 11, 1989

[54] DETACHABLE BLADE ASSEMBLY FOR A CHAIN SAW

[75] Inventor: Carl J. Alexander, Three Rivers, Mich.

[73] Assignee: Pro Power Corporation, Kalamazoo, Mich.

[21] Appl. No.: 94,715

[22] Filed: Sep. 9, 1987

[51] Int. Cl.[4] ..... B27B 17/14

[52] U.S. Cl. ..... 30/500; 30/122; 30/386

[58] Field of Search ..... 30/122, 381–387, 30/500

[56] References Cited

U.S. PATENT DOCUMENTS

| | | | |
|---|---|---|---|
| 834,251 | 10/1906 | Bailey . | |
| 2,774,395 | 12/1956 | Tweedie . | |
| 2,839,097 | 6/1958 | Siria | 30/500 X |
| 2,910,099 | 10/1959 | Mall . | |
| 3,414,026 | 12/1968 | Merz . | |
| 3,636,995 | 1/1972 | Newman | 30/386 |
| 4,270,270 | 6/1981 | Loyd | 30/122 |
| 4,309,931 | 1/1982 | Alexander . | |
| 4,382,334 | 5/1983 | Reynolds | 30/386 |

FOREIGN PATENT DOCUMENTS

| | | | |
|---|---|---|---|
| 2042974 | 10/1980 | United Kingdom | 30/386 |

*Primary Examiner*—Frank T. Yost
*Assistant Examiner*—Michael D. Folkerts
*Attorney, Agent, or Firm*—Gordon W. Hueschen

[57] ABSTRACT

A power-driven saw is disclosed having a readily-detachable, integrated endless-belt cutting assembly unit. The saw includes a power unit having a housing, and further includes a cutting assembly unit which can be mounted on the power unit, and detached therefrom, as a unit. The integrated cutting assembly unit includes a generally plate-like cutting element support, and an endless-belt cutting element (e.g., a saw chain articulated blade, or the like) which extends generally about the periphery of the support for high speed cutting movement thereabout. The integrated cutting assembly unit further includes means for driving the endless-belt cutting element, with the drive means being operatively-coupled with the motor of the power unit of the saw when the integrated cutting assembly unit is mounted to the power unit. The integrated cutting assembly unit further includes means for selectively-varying the tension of the endless saw blade for assuring optimum cutting performance, and which, desirably, permits the cutting element to be selectively-tensioned even when the integrated cutting assembly is detached from the power unit. The easily-detachable nature of the integrated cutting assembly unit greatly facilitates maintenance of the cutting element, and permits the power unit of the saw to be easily equipped with a new cutting element so as to avoid or minimize undesirable interruptions in cutting operations.

24 Claims, 3 Drawing Sheets

10
28
5
74
12
18
34
32
48
72
24
26
36
14

62
68
42
48
52
32
78
60
36
40

71
22
12
18
77
76
26
24
66
44
50
62
48
60
40
32
34
36
14
72
74

DETACHABLE BLADE ASSEMBLY FOR A CHAIN SAW

FIELD OF THE INVENTION

The present invention relates generally to power-driven saws having endless-belt cutting elements and is particularly directed to a power-driven chain saw having a quickly detachable, integrated articulated cutting element assembly unit therefor.

BACKGROUND OF THE INVENTION AND PRIOR ART

Various types of chain saws are known having endless, closed-loop or ansiform cutting elements or bands. Such saws usually include a plate-like support member which carries and supports the endless cutting element, with the cutting element being driven generally about the periphery of the support member. A drive sprocket or the like is provided for drivingly-engaging the cutting element, with the motor of the saw acting to drive the sprocket for effecting high-speed movement of the cutting element for cutting operations. A motor means such as a pneumatic motor, a hydraulic motor, an electric motor, or an internal combustion engine is typically provided for powering the saw.

Various constructions are also known for chain saws, with a cutting element construction usually selected with consideration of the intended use of the saw. For example, some cutting elements comprise saw chains, which are particularly suited for efficient and high-speed cutting of wood, such as for logging and tree trimming. Other cutting elements include an endless array of planar cutting members hingedly-interconnected to form an articulated cutting blade, with relatively narrow kerf, which results from such articulated blades making, them particularly suited for use in the cutting of meat carcasses in butchering operations, or other cutting operations where narrow kerf and relatively low power requirements are important.

One problem encountered with chain saws is maintenance of the cutting element belt or chain for efficient and high-speed cutting. Naturally, such cutting elements must be periodically sharpened. This can be time-consuming, usually requiring removal of the cutting element belt or chain from the saw. Similarly, any failure of a cutting element can result in an undue interruption in work operations since the damaged element must be removed and replaced, which again can be undesirably time-consuming. As will be appreciated, facilities to repair or sharpen the saw may not be close at hand, such as during logging operations in the field. Since an interruption in work operations for saw maintenance is frequently unacceptable, it becomes necessary to bring a back-up saw, or at least back-up chains, to the work site. Of course, the need to maintain another entire saw ready for use significantly increases equipment and maintenance costs for performing the particular cutting operation.

As noted, chain saws having articulated cutting blades are particularly well suited for use in butchering operations. For such application, not only must articulated blades of such saws be properly maintained for efficient cutting, but such saws routinely must be thoroughly cleaned and sterilized to prevent undesired contamination of the meat products they are used to cut. Ordinarily, not only must the entire articulated cutting blade be cleaned but, additionally, the blade support and blade driving mechanism must be free of any matter which might spoil and/or cause contamination. Since a saw must usually be taken out of service for cleaning, back-up equipment is again required in order for butchering operations to continue.

For best performance, it is very important that the tension of the endless cutting element loop of a power-driven saw be properly adjusted. In the past, tension adjustment has typically been effected by providing an arrangement for displacing the cutting element support, e.g., the saw bar or blade support, of the saw with respect to the drive sprocket or the like which drives the endless cutting element. Such adjustment is usually made by altering the position of the cutting element support with respect to the motor housing of the saw after the support and endless cutting element construction have been mounted on the housing. See, for example, U.S. Pat. No. 4,382,334 to Reynolds. Although such arrangements can effect the desired tension adjustment, pre-tensioning of the cutting element loop is not possible. Also, it can again be time-consuming to adjust the cutting element tension each time the cutting element support is removed and reattached, thus detracting from efficient and convenient operation of the saw. Moreover, proper tension adjustment for optimum performance requires a skill that may not be readily available in the field.

In view of the above, it will be recognized that it is highly desirable to provide a power-driven saw with an easily-replaceble endless cutting element arrangement. Preferably, replacement of the cutting element arrangement should be possible in a minimum amount of time, preferably without the use of tools or the like. It is further desirable to provide an arrangement whereby the endless cutting element or chain for a saw can be selectively pre-tensioned. By providing a chain saw with a readily-detachable, pre-tensioned and replaceable endless cutting element or chain assembly which can be easily removed and replaced as a unit, cutting operations can be more efficiently and conveniently performed, with attendant savings in equipment maintenance time and expense.

SUMMARY OF THE INVENTION

A chain saw embodying the principles of the present invention greatly facilitates convenient maintenance and service of the endless-belt cutting element or chain of the saw. In one illustrated and preferred embodiment, the endless cutting element of the saw comprises an articulated saw blade which forms part of an integrated and self-contained cutting assembly unit which is detachably-mounted on the power unit of the saw so that the entire cutting assembly can be easily removed from the power unit for service or cleaning, or for ready replacement of the entire cutting assembly. Notably, the saw is preferably constructed so that the cutting assembly unit can be mounted on and detached from the power unit of the saw without the use of tools in a very short period of time. Further, the integrated cutting assembly unit includes self-contained means for .varying the tension of the articulated cutting blade to assure optimum cutting performance and to facilitate hand driven movement of the articulated blade for cleaning when the cutting assembly is detached from the power unit.

The illustrated embodiment of the present saw includes a relatively lightweight, hand-holdable power unit having a housing. The power unit preferably includes an electric or pneumatic motor, or like prime mover, for powering the saw. The power unit further includes a motor drive shaft which is rotatably-mounted in the unit's housing. The shaft is operatively-connected with the motor of the unit so that operation of the motor drives the motor drive shaft.

The present saw further includes an integrated saw or cutting assembly unit which is adapted to be detachably-mounted, as a unit, on the housing of the power unit so that the power unit drives the integrated cutting assembly unit. The cutting element for the saw can be an endless belt or chain.

In a preferred form, the cutting assembly unit includes a generally plate-like blade or cutting element support which carries and supports the endless cutting element, e.g., the articulated saw blade. The cutting element extends generally about the preiphery of the cutting element support, and is adapted for high-speed movement threabout to effect cutting.

The integrated cutting assembly unit further includes a cutting element drive assembly operatively-connected with the cutting element support for driving the endless-belt cutting element for movement about the support. Notably, the cutting element support has self-contained means for moving it with respect to the drive assembly for selectively-varying the tension of the endless cutting element, and self-contained means for maintaining the selected tension independent of the housing of the saw's power unit.

The drive assembly includes a drive sprocket which is adapted to drivingly-engage the endless cutting element. The drive sprocket is mounted on a drive shaft rotatably-supported by a yoke, e.g. a pair of juxtaposed clamp members, of the drive assembly, with the sprocket drive shaft adapted to be removably but operatively-coupled with the motor drive shaft of the power unit of the saw through a quick-release coupling. The cutting element drive assembly of the integrated cutting assembly unit is also provided with quick-release means for detachably-mounting it on the housing of the power unit of the saw, thus permitting the entire cutting assembly unit to be easily and quickly mounted on and detached from the saw's power unit. Advantageously, the quick-release means comprises means for detachably-affixing the yoke of the cutting assembly unit to the power housing.

To provide tension adjustment for efficient cutting action by the endless cutting element, the relative position of the cutting element drive assembly and the cutting element support can be selectively-altered whereby the overall length of the integrated cutting assembly unit can be selectively-altered. In the illustrated embodiment, alteration of the relative position of these components of the integrated cutting assembly is accomplished by configuration of the interconnected portions of the cutting element drive assembly and the cutting element support. Specifically, a portion of the cutting element support is disposed between the pair of clamp members or yoke of the drive assembly in such a manner that the cutting element support can be moved longitudinally with respect to the cutting element drive assembly. Means are provided for releasably-urging the clamp members toward each other so that the clamp members releasably, compressingly-engage and grip the cutting element support. Since the drive sprocket is rotatably-supported in the cutting element drive assembly, movement of the drive assembly relative to the cutting element support (with the endless cutting element extending generally about the periphery of the support) acts to move the support and drive sprocket with respect to one another for selective variation of the cutting element.

To facilitate convenient and precise tension adjustment of the endless cutting element, the drive assembly includes an adjustment member threaded to one of the clamp members. The adjustment member is adapted to bear against a portion of the cutting element support so that after the support is released from the grip of the clamp members, the relative position of the support and the drive assembly can be easily altered by rotating the adjustment member. The clamp members are then urged toward each other to grip the cutting element support for maintaining the selected tension of the cutting element. Notably, tension adjustment can be easily made even when the integrated cutting assembly unit is detached from the saw's power unit, thus desirably-permitting selective "pre-tensioning" of the cutting element, and also desirably-permitting the endless cutting element to be driven when the integrated cutting assembly is detached from the power unit, such as for cleaning.

To prevent relative rotation between the integrated cutting assembly unit and the housing of the saw's power unit, one of the housing and the cutting assembly unit is provided with a locking projection, while the other of the housing and cutting assembly unit defines a projection-receiving means adapted to receive the locking projection when the cutting assembly unit is connected to the power unit housing. This can comprise complementary longitudinally-disposed, tongue and groove construction or the locking projection can comprise yoke-like means adapted to straddle opposite complementary parts of the device.

To prevent relative rotation between the cutting element drive assembly and the cutting element support, the drive assembly preferably includes a key affixed to one of the two clamp members, with the portion of the cutting element support adapted to be gripped between the two clamp members defining a keyway within which the support key extends. Since the cutting element support is usually provided with a generally planar and elongated configuration, the support key and corresponding keyway are oriented generally parallel to the longitudinal axis of the support, thus accommodating relative longitudinal movement between the cutting element drive assembly and the cutting element support itself for adjustment of the tension of the endless cutting element.

Numerous other advantages and features of the present invention will become readily apparent from the following detailed description of the invention and embodiment thereof, from the claims, and from the accompanying drawings.

DESCRIPTION OF THE PREFERRED EMBODIMENT

Figures 1, 2, 3:
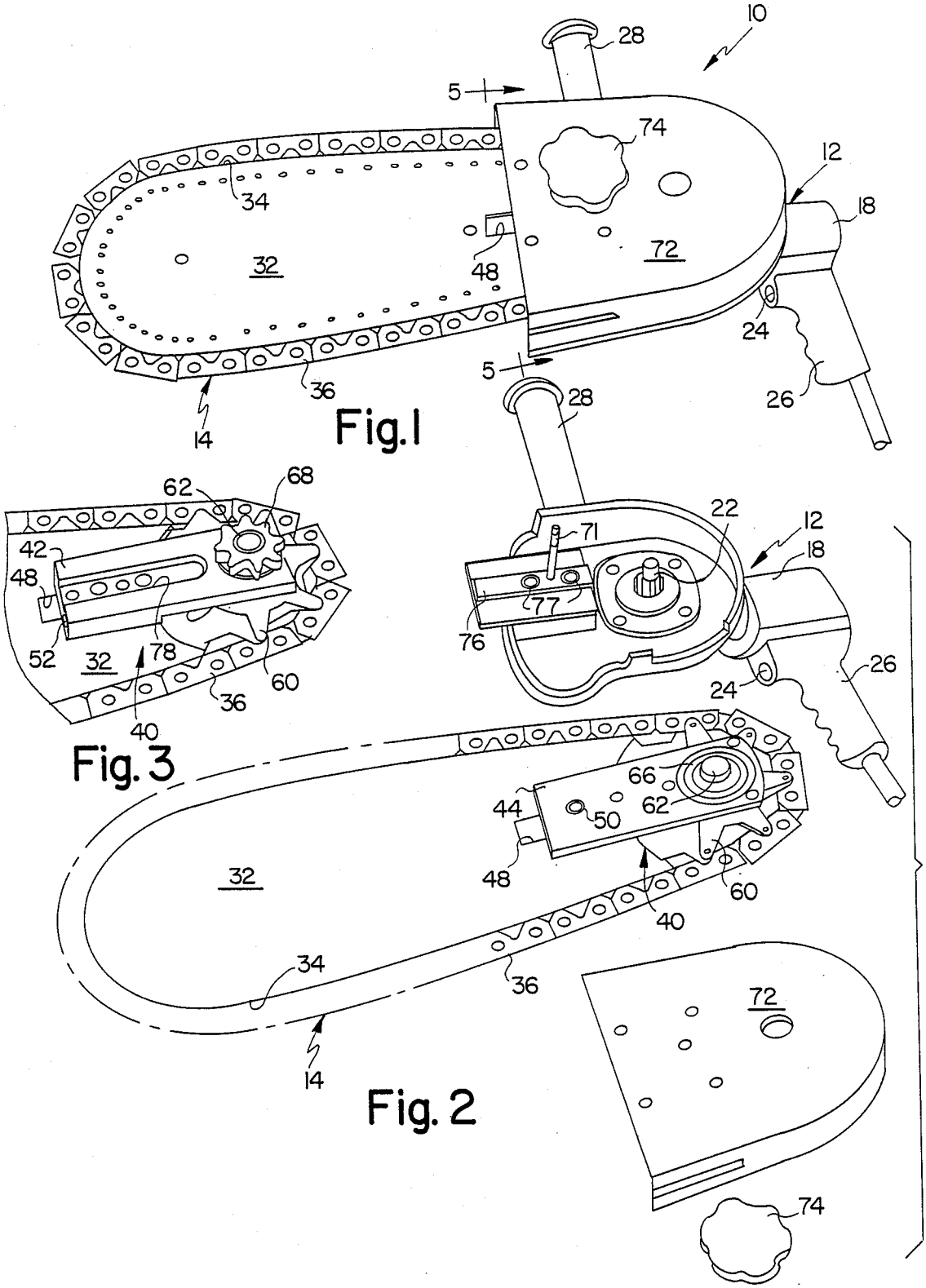
FIG. 1 is a perspective view of a power-driven saw embodying the principles of the present invention and having an endless-belt, articulated cutting blade.
FIG. 2 is a further perspective view of the power-driven saw shown in FIG. 1, exploded to illustrate the removability of the integrated cutting assembly unit of the saw.
FIG. 3 is a fragmentary, perspective view of the opposite side of the integrated cutting assembly unit shown in FIG 2.

While the present invention is susceptible of embodiment in various forms, there are shown in the drawings and will hereinafter be described preferred and modified embodiments of the invention. However, it is to be understood that the present disclosure is an exemplification of the invention and is not intended to limit the invention to the specific embodiment illustrated.

With reference to FIGS. 1–3, a power-driven saw 10 embodying the principles of the present invention is illustrated. As will be further described in detail, the saw 10 includes a hand-holdable power unit 12, and an integrated or unitary cutting assembly unit 14 which is adapted for detachable mounting on the power unit 12. By this construction, the entire integrated cutting assembly unit 14 can be easily removed, as a unit, from the power unit 12 for maintenance of the saw and its various components.

Figure 4:
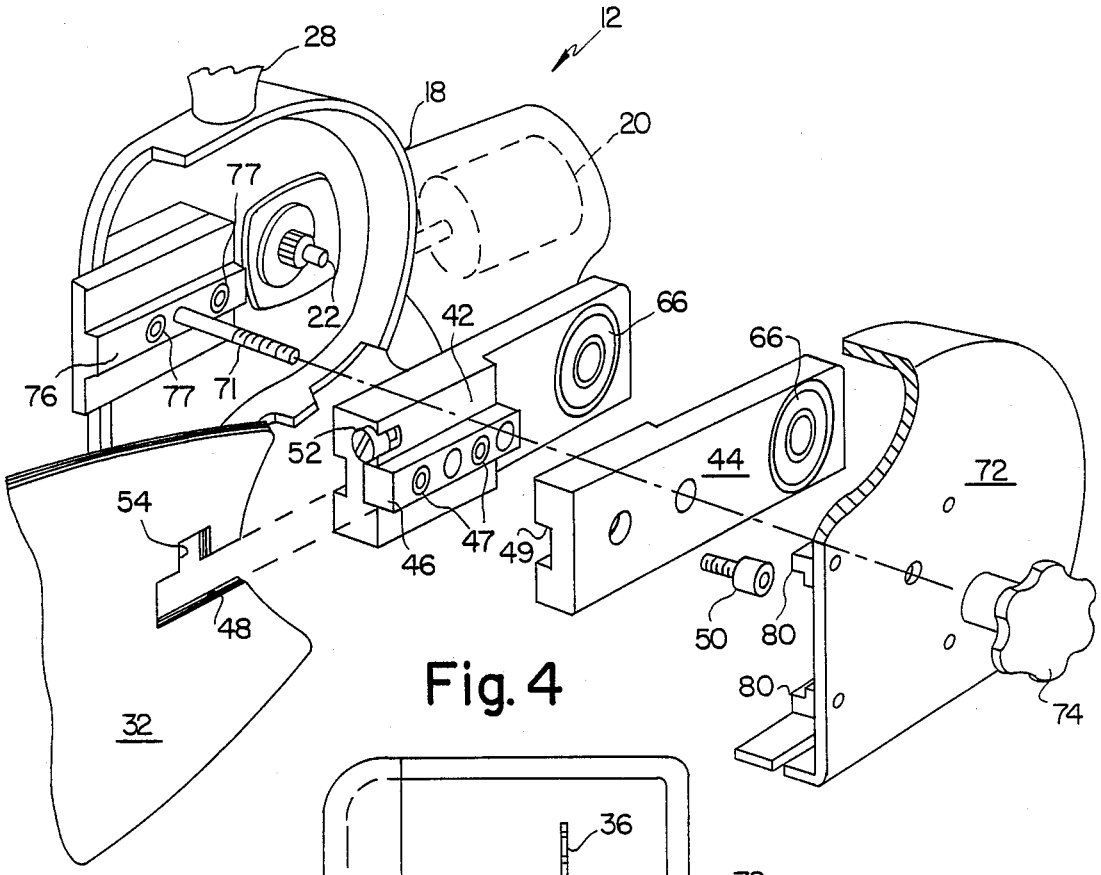
FIG. 4 is an exploded, partial perspective view, partially cut away to show interior detail, of the present power-driven saw.

The power unit 12 includes a housing 18 which houses a motor, such as pneumatic motor 20 (illustrated diagrammatically in phantom line in FIG. 4). The power unit further includes an externally-splined motor drive shaft 22 which is rotatably-mounted in the housing 18, and which extends transversely of the housing. The drive shaft 22 is operatively-connected with the motor 20, such as via suitable gearing (not shown) to drive the cutting element for the saw. The power unit can further include a trigger switch 24 for selective operation of motor 20, with the switch 24 preferably positioned adjacent a pistol-grip handle portion 26. An additional handle 28 can be provided on the power unit 12 for facilitating convenient use and manipulation of the saw during cutting operations. It should be noted that while power unit 12 has been illustrated as including a pneumatically-powered motor 20, the power unit may alternatively include a like prime mover, such as an electric or hydraulic motor, or an internal combustion engine.

The detachable integrated cutting assembly unit 14 includes an elongated, plate-like blade or cutting element support 32. Blade track 34 is defined about the major peripheral portion of the support 32. The integrated cutting assembly unit 14 further includes an endless-belt cutting element, which in this illustrated embodiment, comprises an articulated cutting or saw blade 36 which is carried by and supported in or on the track 34 of the blade support 32 for guided, high-speed movement generally about the periphery of the blade support. As noted, various types of constructions are known for endless-belt cutting elements, with the illustrated articulated blade 36 being of the type disclosed in U.S. Pat. No. 4,309,931 to Alexander. As will be further described, a saw constructed in accordance with the teachings herein can include an endless-belt cutting element of many different configurations, with the configuration of the cutting element usually selected in accordance with the intended use of the saw.

The integrated cutting assembly unit 14 further includes a blade or cutting element drive assembly 40 operatively-connected to blade support 32 at one end thereof. Drive assembly 40 is adapted for detachable mounting on housing 18 of power unit 12 in predetermined, fixed relationship therewith (i.e., the drive assembly 40 is always mounted in the same relative position with respect to housing 18). Thus, detachable mounting of the entire integrated cutting assembly unit 14 to the power unit is facilitated without affecting blade tension.

Figure 5:
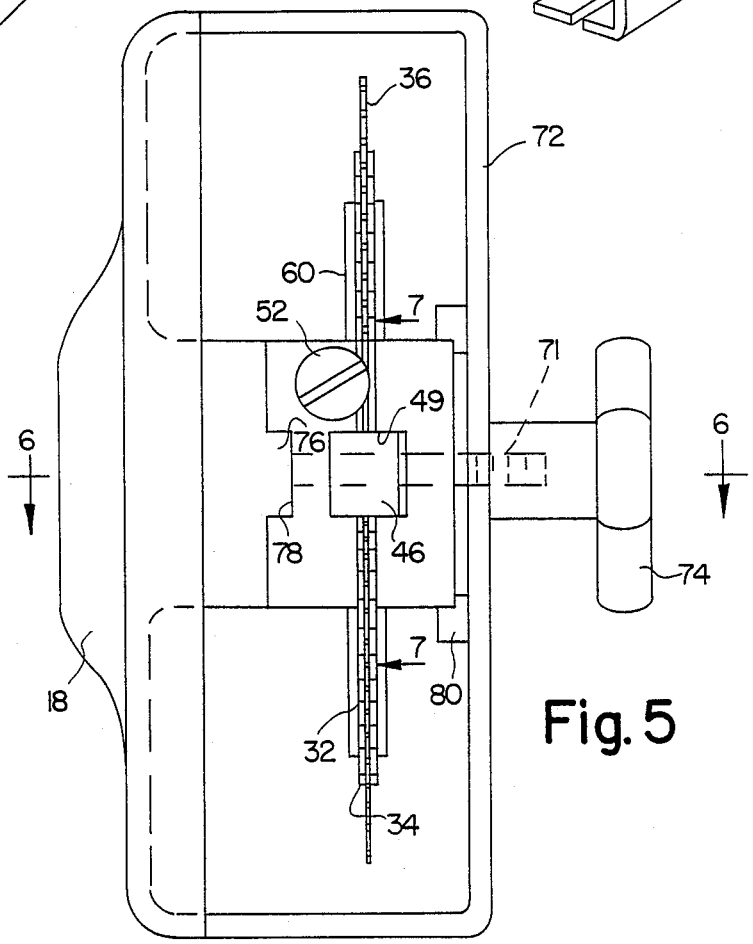
FIG. 5 is a view partially in section, taken along plane 5—5 of FIG. 1.

As best illustrated in FIGS. 4 and 5, the drive assembly 40 includes a pair of apposed clamp members 42, 44, which receive therebetween a portion of blade support 32. Clamp members 42, 44 operatively-connect the drive assembly 40 with the blade support 32. To this end, drive assembly 40 includes a blade support key 46 affixed to one of the clamp members (i.e., clamp member 42 in the illustrated embodiment) with fasteners 47. The support key 46 is adapted to fit within inwardly-facing, opposed cutout portion 49 of the clamp member 44, as best shown in FIG. 5.

The support key 46 is adapted to extend within a support keyway 48 defined by the portion of blade support 32 which is received between the two clamp members 42, 44. The support key 46 cooperates with blade support 32 to prevent relative rotation between the blade support 32 and the drive assembly 40. It will be noted that the support key 46 and the keyway 48 prefereably extend in a direction parallel to the longitudinal axis of the generally-elongated blade support 32. This accommodates selective alteration of the relative position of blade support 32 and the drive assembly 40 for selectively-varying the tension of articulated blade 32, as will be further described.

The clamp member 42, 44 are adapted to releasably- and compressingly-engage and grip the portion of blade support 32 received between the clamp members so that the drive assembly 40 and the blade support can be securely but releasably-fixed as an integral unit. To this end, a releasable, threaded fastener 50 is provided for holding the clamp members 42, 44 together, and for releasably-urging the clamp members toward each other. Thus, when the integrated cutting assembly unit 14 is assembled, blade support 32 is received between the clamp members 42 and 44 so that support key 46 fits within keyway 48, and fastener 50 is tightened so that the clamp members engage and positively-grip the blade support. By loosening the fastener 50, on the other hand, the grip of the clamp members is released and the relative position of blade support 32 with respect to the drive assembly 40 can be easily altered.

Figure 7:
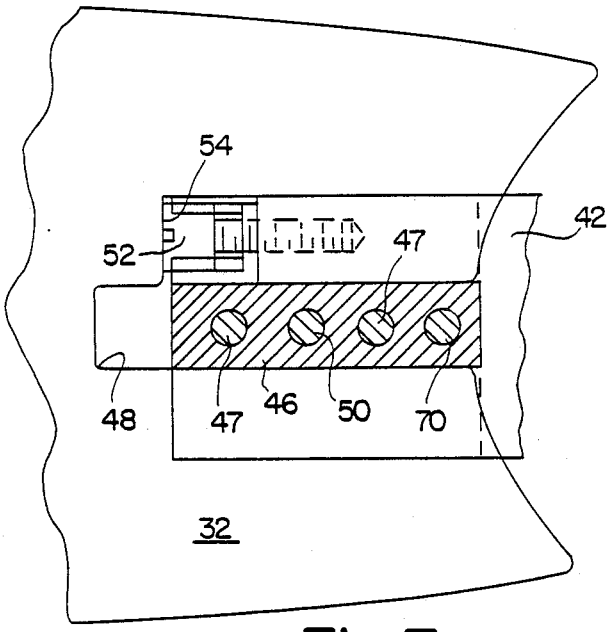
FIG. 7 is a fragmentary view partially in section, taken along plane 7—7 of FIG. 5.

As will be recognized, clamp members 42 and 44 coact with blade support 32 to maintain any selected tension of articulated blade 36. While a fixture or jig can be used for relatively-positioning drive assembly 40 and blade support 32 for achieving the desired degree of tension in blade 32, the drive assembly 40 preferably includes means for precisely-effecting tension adjustment. The drive assembly 40 includes a threaded adjustment member 52 which is threaded into one of the clamp members, specifically clamp member 42. The adjustment member 52 is disposed between the distal end of blade support 32 and the sprocket (as will be further described) which drives articulated blade 36, with member 52 generally-encircled by articulated blade 36. When blade support 32 is positioned between clamp members 42, 44, the head portion of adjustment member 52 is adapted to abut and bear against a cutout portion 54 of the blade support (see FIG. 7). The axis of the threaded adjustment member 52 is preferably arranged parallel to the longitudinal axis of the elongated blade support 32. Thus, after blade support 32 has been released from the grip of clamp members 42 and 44, by loosening of threaded fastener 50, adjustment member 52 can be rotated so that it bears against cutout 54 of the blade support so that the relative position of the blade support 32 and the drive assembly can be precisely altered to provide articulated blade 36 with the desired degree of tension.

Figure 6:
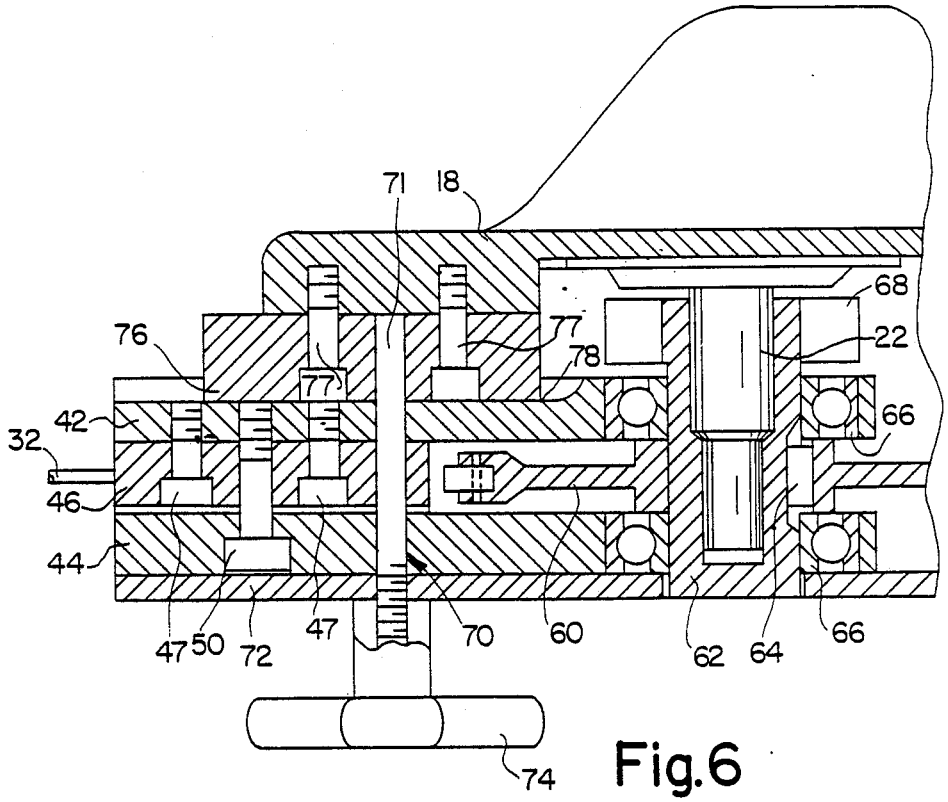
FIG. 6 is a view partially in section, taken along plane 6—6 is FIG. 5.

The drive for articulated blade 36 will now be described. The drive assembly 40 includes a cutting element or blade drive sprocket 60 which is adapted to drivingly-engage articulated blade 36. In this regard, clamp members 42, 44 rotatably-support drive sprocket 60 and operatively connect the drive sprocket with the blade support 32. More specifically, the drive sprocket 60 is mounted on an internally-splined sprocket drive shaft 62, and is keyed for rotation therewith with a key 64 (FIG. 6). The sprocket drive shaft 62 is in turn journaled on and rotatably-supported by the clamp members 42 and 44, with bearings 66 such that the drive sprocket 60 is disposed generally between the clamp members 42 and 44. As will be recognized, displacement of drive sprocket 60 with respect to blade support 32 acts to vary the tension of the articulated blade 36 which extends about the blade support and the drive sprocket. Thus, selective variaton of the tension of the blade is readily accommodated by selectively-altering the relative position of blade support 32 and drive assembly 40, as previously described. As will be appreciated, the construction of integrated cutting assembly unit 14 is such that the unit itself includes the means for varying the tension of blade 36, as well as the means for maintaining the selected tension, thus permitting the blade to be conveniently "pre-tensioned" while the assembly unit 14 is removed from power unit 12.

As discussed above, some cutting operations require the periodic cleaning of articulated blade 36. In this regard, the integrated blade assembly unit 14 can include an auxiliary drive sprocket 68 affixed to the sprocket drive shaft 62. Auxiliary drive sprocket 68 facilitates movement of articulated blade 36 about blade support 32, such as for cleaning, when the integrated cutting assembly unit 14 is detached from the power unit 12 and suitably supported, with suitable drive means, hand-operated or powered (not shown) attached to auxiliary drive sprocket 68. If desired, suitable drive means (not shown) with a splined shaft which can be inserted into the internally-splined shaft 62 can be used. Significantly, operation in this manner is greatly facilitated by the configuration of cutting assembly unit 14, which permits the articulated blade to be pre-tensioned and maintained at the selected tension, even when the cutting assembly is not mounted on the power unit of saw 10.

The internally splined sprocket drive shaft 62 is adapted to be removably-coupled with motor drive shaft 22 of power unit 12 when integrated cutting assembly unit 14 is mounted on the power unit. Since it is desired that the integrated cutting assembly unit 14 be readily detachable from the power unit 12, the present saw is preferably configured so that drive assembly 40, and thus the entire integrated cutting assembly unit 14, can be detachably- and fixedly-mounted on power unit 12 with hand-operable fastening means. To this end, an elongated, mechanical fastener 70 is provided, including a threaded shaft 71 which is preferably affixed to housing 18 of power unit 12 in parallel relation to the transversely-extending motor drive shaft 22. The threaded shaft 71 is adapted to extend through clamp members 42 and 44 and support key 46 when the integrated cutting assembly unit 14 is fitted to the power unit.

Threaded shaft 71 is further preferably adapted to extend through a removable protective cover 72 which is adapted to be removably-mounted on the housing 18 for enclosing a portion of the integrated cutting assembly unit 14 at the drive of articulated blade 36. The fastener 70 includes a threaded-hand-grippable knob 74 which can be fitted to the projecting end of threaded shaft 71 outwardly of protective cover 72 so that tightening of the knob 74 releasably-compresses the drive assembly 40 of integrated cutting assembly unit 14 between housing 18 and cover 72 to securely affix the integrated cutting assembly unit 14 and cover 72 to housing 18 of power unit 12. With the cutting assembly unit so attached to housing 18, the complementary splined configurations of motor drive shaft 22 and sprocket drive shaft 62 operatively-couple the shafts in a driving relationship (FIG. 6) with respect to one another.

While use of a single fastener 70 is preferred for ease in attaching and detaching integrated cutting assembly unit 14, it will be recognized that any moment arm created about fastener 70 attendant to cutting operations (e.g., from loading of blade support 32) could undesirably result in undue side loading of motor drive shaft 22 and sprocket drive shaft 62. Therefore, the present saw preferably includes an arrangement for preventing relative rotation between the housing 18 of power unit 12 and the drive assembly 40. The drive assembly 40 and the housing 18 are preferably fixed against relative rotation by a locking projection provided on one of the housing 18 and and the drive assembly 40, with a projection-receiving means defined by the other of the housing and the drive assembly. In the illustrated embodiment, a key-like locking projection 76 is affixed to housing 18 with fasteners 77, with the locking projection 76 being received within a projection-receiving keyway 78 defined by clamp member 42 of drive assembly 40 (see FIG. 3, which illustrates the portion of clamp member 42 adapted to face the housing, 18 of power unit 12). In a modified form not shown, a yoke element 75 mounted on the housing 18 is adapted to straddle the clamps 42 and 44 and thus prevent the undesired rotation.

From the foregoing, preparation of the present saw for use will be readily appreciated. Before mounting on power unit 12, the integrated cutting assembly unit 14 of the saw appears generally as shown in FIG. 2. The cutting assembly unit 14 can then be fitted to the power unit 12 so that threaded shaft 71 of fastener 70 extends through drive assembly 40, with locking projection 76 received within keyway 78, and motor drive shaft 22 operatively-coupled with sprocket drive shaft 62. Protective cover 72 is then fitted so that the shaft 71 extends therethrough. If desired, cover 72 may be provided with locking or yoke element projections 80 which fit the protective cover 72 to clamp member 44 to prevent any relative rotation between the cover 72 and the drive assembly 40. Threaded knob 74 is then fitted to threaded shaft 71 and tightened, and the saw is ready for use. The above procedure is reversed for removal of integrated cutting assembly unit 14, such as for adjustment of the tension blade 36, cleaning, sharpening, or other maintenance or replacement of the blade.

Figure 8:
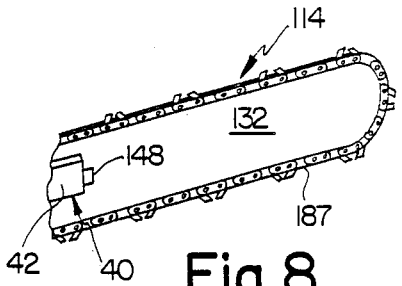
FIG. 8 is a fragmentary perspective view of a modified form of the integrated cutting assembly unit of the present saw, including an endless belt chain saw blade.

As previously noted, a power-driven saw having an integrated cutting assembly in accordance with the present invention, can include an endless-belt cutting element construction other than the articulated blade 36 thus far described. Accordingly, FIG. 8 shows a portion of a modified integrated cutting assembly unit 114, including a cutting element support comprising a saw bar 132 about which extends an endless-belt cutting element comprising a saw chain 187. Those familiar with the art will recognize the construction of saw chain 187 as including chain rollers which rollingly-engage the periphery of saw bar 132 for guided high-speed movement of the chain about the saw bars. Saw bar 132 can be operatively-connected with the previously-described drive assembly 40, and to this end the saw bar 132 preferably defines a longitudinally-oriented keyway 148. Drive of saw chain 187 is effected via a suitable conventional chain drive sprocket (not shown) rotatably-mounted in drive assembly 40.

The foregoing is intended as illustrative but not limiting. Variations and modifications may be effected without departing from the true spirit and scope of the novel concept of the present invention. No limitation with respect to the specific embodiment illustrated herein is intended or should be inferred. It is, of course, intended to cover by the appended claims all such modifications as fall within the scope of the claims.

I claim:

1. A power-driven saw, comprising:

a power unit including a housing, motor means disposed within said housing, and driven shaft means rotatably-mounted in said housing and adapted to be driven by said motor means;

an integrated, self-contained, elongate, narrow cutting assembly unit adapted to be attached and detached as a unit on the housing of said power unit and to operatively connect with said driven shaft when attached and disconnect from said driven shaft when detached so that said power unit drives said cutting assembly unit when it is attached to said housing;

means for detachably mounting said cutting assembly unit as a unit on said housing, said cutting assembly unit including a cutting element support means, an endless-belt cutting element means supporting by said support means for movement thereabout, and a cutting element drive assembly rotatably mounted on said support means which is adapted to drivingly-engage said cutting element means for moving said cutting element means about said support means;

said cutting element support means, said endless-belt cutting element means, and said cutting element assembly being integrated into a unitary structure which can be attached to or detached from the housing of said power unit as an intact unit which is operative both when said cutting assembly unit is attached to the housing of said power unit and when it is not;

coupling means for coupling aid cutting element drive assembly with said drive shaft means when said cutting assembly unit is mounted on said housing; and tension-maintaining means on said cutting assembly unit for maintaining a selected tension of said endless-belt cutting element means whether or not said cutting assembly unit is attached to the housing of said power unit.

2. The power-driven saw of claim 1, wherein said cutting element drive assembly comprises drive sprocket means and means for rotatably-supporting said drive sprocket means on said cutting element support means and operatively-connecting said drive sprocket means with said cutting element means whether or not said cutting element drive assembly is attached to the housing of said power unit.

3. The power-driven said of claim 1, including, in addition to said tension-maintaining means, tension-varying means on said cutting assembly unit for alternately maintaining and selectively-varying the tension on said endless-belt cutting means which tension-maintaining and tension-varying means are operative when said cutting assembly unit is detached from the housing of said power drive means.

4. The power-driven saw of claim 2, wherein said housing and said cutting element drive assembly include longitudinal elongate complementary locking projection means and projection-receiving means for preventing relative rotation therebetween.

5. The power-driven saw of claim 2, wherein said coupling means includes a hollow internally-splined shaft for rotatably-supporting said drive assembly, which hollow shaft is adapted to mesh with complementary splines on said driven shaft, whereby said drive assembly can be coupled or uncoupled simply by an axial movement of the hollow splined shaft on or off of the splined driven shaft.

6. The power-driven saw of claim 5, wherein said driven assembly further includes auxiliary drive means mounted on said internally-splined shaft adapted to be driven for driving said cutting element means when said cutting assembly unit is detached from said housing.

7. The power-driven saw of claim 6, wherein said drive assembly is shaped to receive a complementary, elongate locking projection means when said cutting assembly is mounted on said housing for preventing relative rotation therebetween.

8. The power-driven saw of claim 2, including a single bolt-type fastener means affixed to said housing adapted to extend normally through said cutting element drive assembly for detachably-mounting said cutting element drive assembly on said housing and separable, complementary slot and bar means, one on said housing and the other on said cutting element drive assembly to maintain them in predetermined fixed relationship.

9. The power-driven saw of claim 3, wherein said cutting element drive assembly comprises clamp means for releasably-gripping a portion of said cutting element support means to provide said tension-maintaining means, said tension-varying means being adapted to alter the relative position of said drive assembly and said cutting element support means when said portion of said support means is released from the grip of said clamp means.

10. The power-driven saw of claim 9, wherein said tension-varying means comprises adjustment means threadably-joined to said clamp means, said adjustment means being adapted to bear against a transverse section of said cutting element support means for altering the relative longitudinal position of said support means and said drive assembly.

11. A power-driven saw, comprising:

a hand-holdable power unit including a housing, selectively-operable motor means disposed within said housing, and motor drive shaft means rotatably-mounted in said housing so that said shaft means is adapted to be driven by said motor means; and an integrated, elongate, narrow cutting assembly unit adapted to be detachably-mounted as a unit on the housing of said power unit so that aids power unit drives said cutting assembly unit;

said cutting assembly unit including a cutting element support, and an endless-belt cutting element supported on and extending about said cutting element support;

said cutting element unit further including cutting element drive assembly means rotatably mounted on and within the confines of said cutting assembly, including a rotatably-supported sprocket drive shaft and a cutting element drive sprocket mounted on said sprocket drive shaft, said drive sprocket being adapted to drivingly-engage said endless cutting element for moving said cutting element about said cutting element support;

said cutting element drive assembly means, being adapted for detachable mounting on said housing in predetermined fixed relation therewith for detachable mounting of said integrated cutting assembly unit on said housing, said sprocket drive shaft being coupled with said motor drive shaft means when said integrated cutting assembly unit is mounted on said housing so that operation of said motor means moves said endless cutting element about said cutting element support; and wherein said drive assembly means includes tension-adjustment means for selectively varying the tension of said endless cutting element operative both when the cutting element drive assembly is mounted on the housing of the power-drive means and when it is not.

12. The power-driven saw of claim 11, wherein said cutting element drive assembly means includes in addition to said means for selectively-varying the tension of said endless cutting elements, means for maintaining a selected tension of said cutting element.

13. The power-driven saw of claim 11, wherein said cutting element drive assembly means comprises a cutting element drive assembly including a pair of juxtaposed, clamp members, said sprocket drive shaft extending through said clamp members with said drive sprocket mounted on said sprocket drive shaft generally between said clamp members, said cutting element support including a portion disposed between said clamp members;

said drive assembly further including means for releasably-urging said clamp members together so that said clamp members releasably, compressingly-grip said portion of said cutting element support whereby the relative position of said drive assembly and said cutting element support can be selectively-altered.

14. The power-driven saw of claim 13, wherein said cutting element drive assembly means includes a cutting element support key affixed to one of said clamp members, and said cutting element support defining a complementary keyway within which said support key extends for preventing relative rotation between said cutting element support and said cutting element drive assembly.

15. The power-driven saw of claim 13, wherein one of said housing and said cutting element drive assembly includes locking projection means, and the other of said housing and said drive assembly defining complementary projection-receiving means adapted to receive said locking projection means when said integrated cutting assembly unit is mounted on said housing for preventing relative rotation therebetween.

16. The power-driven saw of claim 13, including auxiliary drive means mounted on said sprocket drive shaft, said auxiliary drive means being adapted to be driven for driving said endless cutting element when said cutting assembly unit is detached from said housing.

17. The power-driven saw of claim 15, including removable protective cover means adapted to be detachably mounted on said housing for enclosing a portion of said integrated cutting assembly unit;

said saw further including mechanical fastener means adapted to extend through said cover means and said cutting element drive assembly of said integrated cutting assembly unit, and be affixed to aid housing for detachably mounting said cutting assembly and said cover means to said housing; and said protective cover having internal yoke means complementary to a clamp member and adapted to embrace the same to prevent rotation of the protective cover.

18. The power-driven saw of claim 14, including tension adjustment means threadably-joined to one of said clamp members so that rotation of said adjustment means moves said adjustment means with respect to one clamp member;

said adjustment means being adapted to bear against a transverse section of said cutting element support so that rotation of said adjustment means after release of said cutting element support from the grip of said clamp members relatively moves said cutting element drive assembly and said cutting element support.

19. An integrated, self-contained elongate, narrow cutting assembly unit adapted to be detachably-mounted as a unit to a power unit having a housing and motor means for driving a motor drive shaft rotatably-mounted in the housing, comprising:

a cutting element support;

an endless-belt cutting element carried by and supported on said cutting element support for movement thereabout;

cutting element drive assembly means rotatably mounted on said cutting element support and adapted to drivingly-engage said endless-belt cutting element for moving said cutting element about said cutting element support, said drive assembly means being wholly contained within the confines of said cutting assembly and operatively-coupled with said motor drive shaft when said cutting assembly is mounted on the housing of said power unit so that said motor means drives said endless-belt cutting element; and tensioning means on said integrated self-contained, cutting assembly means for selectively-varying the tension of said endless-belt cutting element.

20. The integrated cutting assembly unit of claim 19, wherein said drive assembly means includes gripping means for releasably-gripping a portion of said cutting element support whereby the relative position of said drive assembly and said cutting element support can be selectively-varied.

21. The integrated cutting assembly unit of claim 20, wherein said gripping means comprises a pair of clamp members between which said portion of said cutting element support is received, and means for releasably-urging said clamp members together to releasably-grip said portion of said cutting element support;

said drive assembly further including a drive sprocket rotatably-mounted between said clamp members on said drive shaft and adapted to drivingly-engage said endless-belt cutting element.

22. The integrated cutting assembly unit of claim 21, wherein said drive assembly further includes a cutting element support support key affixed to one of said clamp members, said portion of said cutting element support defining a keyway within which said support key extends for preventing relative rotation between said cutting element support and said assembly.

23. The integrated cutting assembly unit of claim 21, including auxiliary drive means mounted on said sprocket drive shaft, said auxiliary drive means being adapted to be driven for moving said endless cutting element when said cutting assembly unit is detached from said housing.

24. The integrated cutting assembly unit of claim 22, wherein said tensioning means comprises tension adjustment means threaded into one of said clamp members, said adjustment means being adapted to bear against a transverse section of said cutting element support for relatively-moving said support and said drive assembly after release of said support from the grip of said clamp members for selectively-varying the tension of said endless cutting element, said clamp members being adapted to grip said portion of said cutting element support for maintaining the selected tension of said cutting element.

* * * * *

UNITED STATES PATENT AND TRADEMARK OFFICE

CERTIFICATE OF CORRECTION

PATENT NO. : 4,819,335

DATED : April 11, 1989 Page 1 of 2

INVENTOR(S) : Carl J. Alexander

It is certified that error appears in the above-identified patent and that said Letters Patent is hereby corrected as shown below:

Title Page, [57] ABSTRACT, line 8; after "chain" insert a comma -- , --

In the Drawings, Sheet 3, FIG 6, in the middle of this drawing circled, is a roller; hence, pin should be centered.

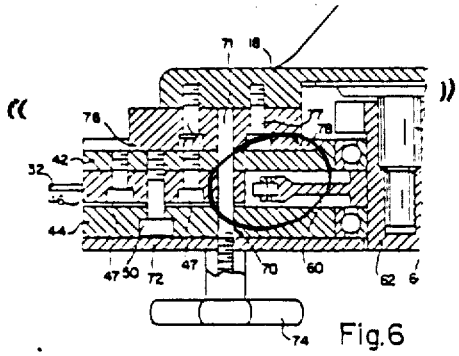

Fig.6 should read

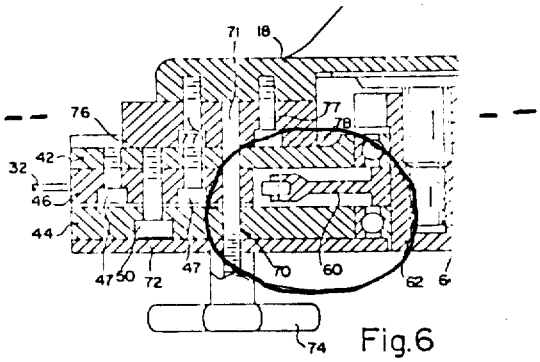

Fig.6

Col. 2, line 30; "replaceble" should read -- replaceable --
Col. 2, line 61; delete the period "." before "vary-"
Col. 3, line 18; "preiphery" should read -- periphery --
Col. 3, line 20; "threabout" should read -- thereabout --
Col. 5, line 12; "endless belt" should read -- endless-belt --
Col. 6, line 33; "prefereably" should read -- preferably --
Col. 7, line 33; "variaton" should read -- variation --
Col. 7, line 62; "internally splined" should read -- internally-splined --
Col. 8, line 41; delete "and" (second occurrence)
Col. 8, line 50; delete the comma "," before "18"

UNITED STATES PATENT AND TRADEMARK OFFICE

CERTIFICATE OF CORRECTION

PATENT NO. : 4,819,335

DATED : April 11, 1989 Page 2 of 2

INVENTOR(S) : Carl J. Alexander

It is certified that error appears in the above-identified patent and that said Letters Patent is hereby corrected as shown below:

Col. 9, line 51; "supporting" should read -- supported --

Col. 9, line 65; "aid" should read -- said --

Col. 10, line 14; "said" should read -- saw --

Col. 10, line 36; "driven" should read -- drive --

Col. 11, line 12; "aids" should read -- said --

Col. 12, line 25; "aid" should read -- said --

Col. 12, line 64; insert a comma -- , -- after "integrated"

Signed and Sealed this

Fifth Day of June, 1990

*Attest:*

HARRY F. MANBECK, JR.

*Attesting Officer*

*Commissioner of Patents and Trademarks*